US011826312B2

(12) United States Patent
Brown

(10) Patent No.: US 11,826,312 B2
(45) **Date of Patent: *Nov. 28, 2023**

(54) SINGLE PILL DISPENSER

(71) Applicant: Kristi Nixon Brown, Cedar Park, TX (US)

(72) Inventor: Kristi Nixon Brown, Cedar Park, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/961,121

(22) Filed: Oct. 6, 2022

(65) Prior Publication Data

US 2023/0031080 A1 Feb. 2, 2023

Related U.S. Application Data

(63) Continuation of application No. 17/063,296, filed on Oct. 5, 2020, now Pat. No. 11,464,709.

(51) Int. Cl.

| | |
|---|---|
| ***A61J 7/00*** | (2006.01) |
| ***A61J 1/14*** | (2023.01) |
| ***A61J 1/03*** | (2023.01) |

(52) U.S. Cl.

CPC ..... *A61J 7/0076* (2013.01); *A61J 1/03* (2013.01); *A61J 1/1412* (2013.01)

(58) Field of Classification Search

CPC ..... A61J 7/0048; A61J 7/0076; A61J 1/03
USPC ..... 221/263, 241, 304, 132; 222/144; 211/77

See application file for complete search history.

(56) References Cited

U.S. PATENT DOCUMENTS

| | | | | |
|---|---|---|---|---|
| 401,829 | A * | 4/1889 | Hall | A47F 5/0037 312/305 |
| 4,582,225 | A * | 4/1986 | Peden | A61C 19/00 211/163 |
| 5,791,515 | A | 8/1998 | Khan et al. | |
| 6,168,046 | B1 * | 1/2001 | Galesi | G07F 11/44 221/133 |
| 7,854,326 | B1 * | 12/2010 | Beckett | A61J 7/0084 206/534 |
| 9,150,346 | B1 * | 10/2015 | Aramian | A61J 7/04 |
| 9,849,069 | B1 | 12/2017 | Khatri | |
| 10,198,556 | B2 | 2/2019 | Herman et al. | |
| 10,457,474 | B2 | 10/2019 | Graziano | |
| 11,464,709 | B2 * | 10/2022 | Brown | A61J 7/0076 |
| 2002/0070227 | A1 * | 6/2002 | Ferruccio | A61J 7/02 221/133 |

(Continued)

*Primary Examiner* — Timothy R Waggoner
(74) *Attorney, Agent, or Firm* — Howard & Howard Attorneys PLLC

(57) ABSTRACT

An apparatus for dispensing pills includes a post having a first base portion and a second rod portion. The apparatus also includes a plurality of pill dispenser modules, a turntable ring that is rotatable with respect to the post, and a housing. The housing has a generally cylindrical shape and has a plurality of pockets with each of the pockets being configured to store a single pill dispenser module of the plurality of pill dispenser modules. The housing has a center hole for slidably attaching the housing to the post, and the housing has at least one blind hole at a bottom surface of each of the cylindrical pockets with the blind hole being mateable with the turntable ring. The apparatus additionally includes turntable plate having a center thru hole to provide attachment with the post, with the turntable plate being attachable with the turntable ring.

20 Claims, 11 Drawing Sheets

(56) References Cited

U.S. PATENT DOCUMENTS

2020/0022876 A1 1/2020 Anderson et al.

* cited by examiner

60

SINGLE PILL DISPENSER

CROSS-REFERENCE TO RELATED APPLICATIONS

The subject application is continuation of U.S. patent application Ser. No. 17/063,296 filed on Oct. 5, 2020, now U.S. Pat. No. 11,464,709, which is herein incorporated by reference in its entirety.

BACKGROUND OF THE DISCLOSURE

1. Field of the Disclosure

This invention relates generally to the field of pill dispensers, and in particular to a pill dispenser capable of dispensing of single pills by simply pressing a button.

2. Description of the Related Art

There are some single pill dispensers from prior art that have tried to provide a convenient method of single pill dispensing. For example, U.S. Pat. No. 10,457,474 issued to Graziano discloses a single pill dispenser that includes a container and a cap having a pill dispensing chamber that is configured to receive a single pill. U.S. Pat. No. 9,849,069 issued to Khatri discloses a push operated single pill dispenser that dispenses a single pill at the push of a button. A third example is U.S. Pat. No. 5,791,515 issued to Khan et al that discloses a single pill dispenser that has a mechanism which allows for attachment to existing pill containers.

However, the prior art single pill dispensers all contain a major flaw that the present invention shall overcome. The main flaw inherent in all prior art single pill dispensers is that they are only used for attachment to a specific pill bottle for a specific medicine. Today many people not only take more than one medication daily, but also take supplements such as fish oil pills. Also, pills are not manufactured to just one size and there is a large range today roughly varying from a few millimeters up to 25 millimeters for supplements such as fish oil pills. Also, many people store their daily medicines in either the original pill bottles or create daily doses of several pills using rectangular storage devices.

Indeed there exists a need to provide a single pill dispenser that can dispense single pills of various sizes as well as store the various medications in a convenient and easy to use dispenser. The present invention will provide these much-needed advantages over prior art single pill dispensers.

SUMMARY OF THE INVENTION

An apparatus for dispensing pills includes a post having a first base portion and a second rod portion protruding upward from the first base portion. The apparatus also includes a plurality of pill dispenser modules, a turntable ring that is rotatable with respect to the post, and a housing. The housing has a generally cylindrical shape and has a plurality of pockets with each of the pockets being configured to store a single pill dispenser module of the plurality of pill dispenser modules. The housing has a center hole for slidably attaching the housing to the post, and the housing has at least one blind hole at a bottom surface of each of the cylindrical pockets with the blind hole being mateable with the turntable ring. The apparatus additionally includes turntable plate having a center thru hole to provide rigid attachment with the post, with the turntable plate being attachable with the turntable ring.

BRIEF DESCRIPTION OF THE DRAWINGS

FIG. 2(*a*) is a sectional view of the single pill dispenser taken along line A-A of FIG. 2.

FIG. 4(*a*) is a sectional view of the single pill dispenser module taken along line A-A of FIG. 4.

FIG. 4(*b*) is a sectional view of the single pill dispenser module taken along line B-B of FIG. 4.

DETAILED DESCRIPTION OF THE INVENTION

Figure 1:
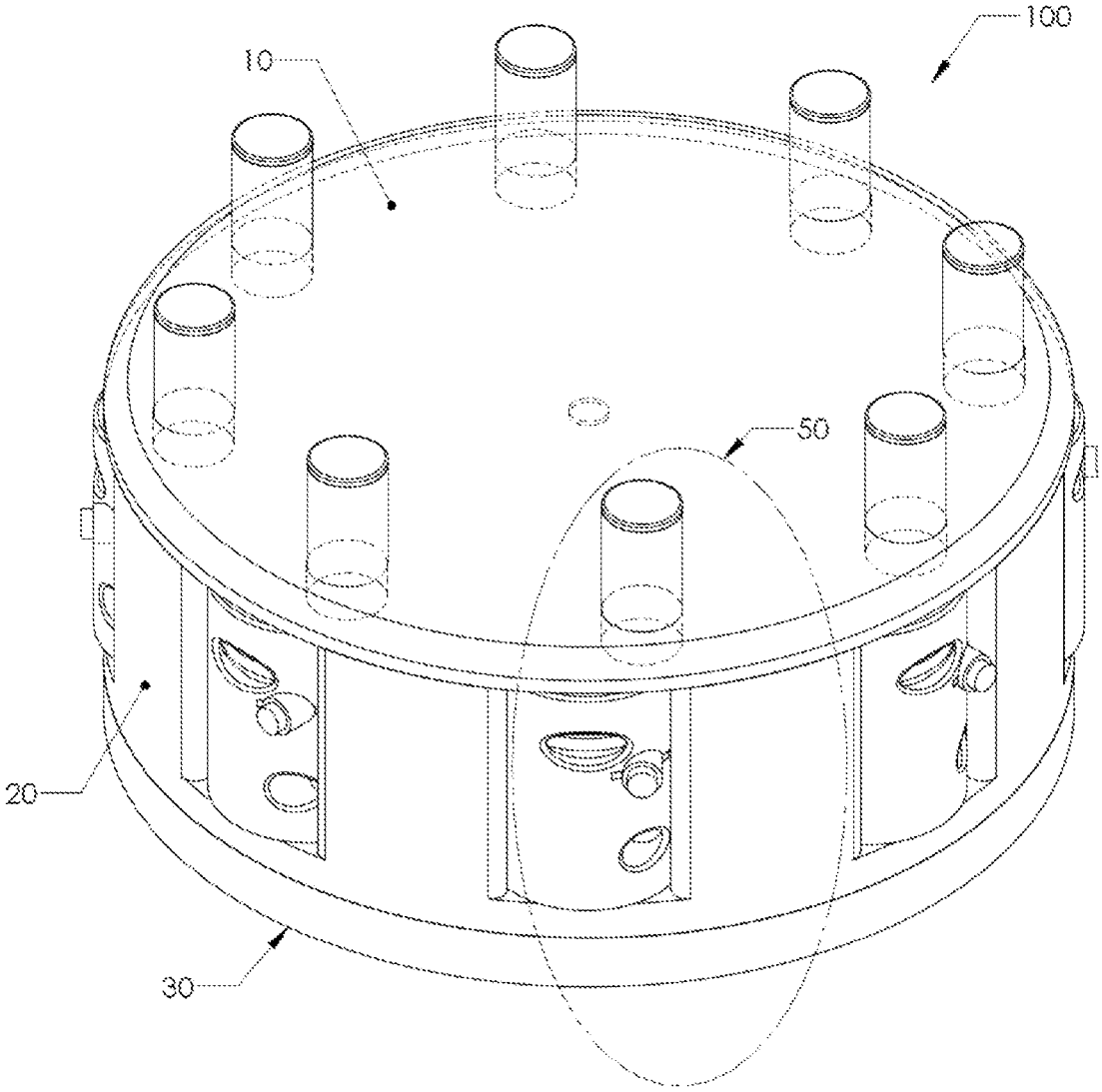
FIG. 1 is a perspective view of the single pill dispenser.

Referring now to the drawings and in particular FIG. 1, a single pill dispenser according to the present invention is generally designated by reference numeral 100. Dispenser 100 includes a top cover 10 which rests on top of the main housing body 20. The main housing body 20 is preferably a cylindrical shape and contains a plurality of single pill dispenser modules 50 that are evenly spaced in a circular arrangement in cylindrical pockets 20*a* defined by the main housing body 20. A turntable plate 30 provides a means for turning the dispenser to dispense a different medication.

Figure 2:
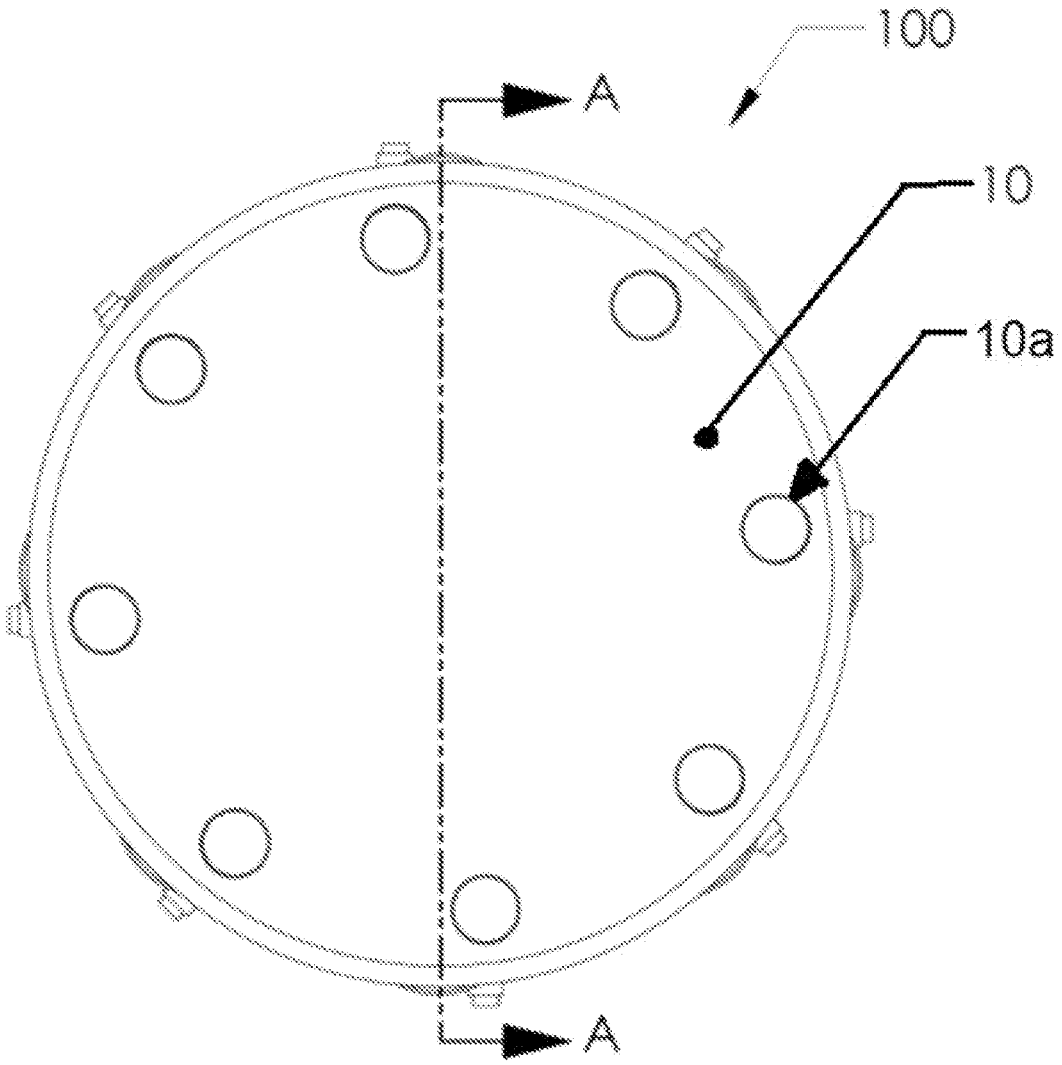
FIG. 2 is a top view of the single pill dispenser.
Figure 2A:
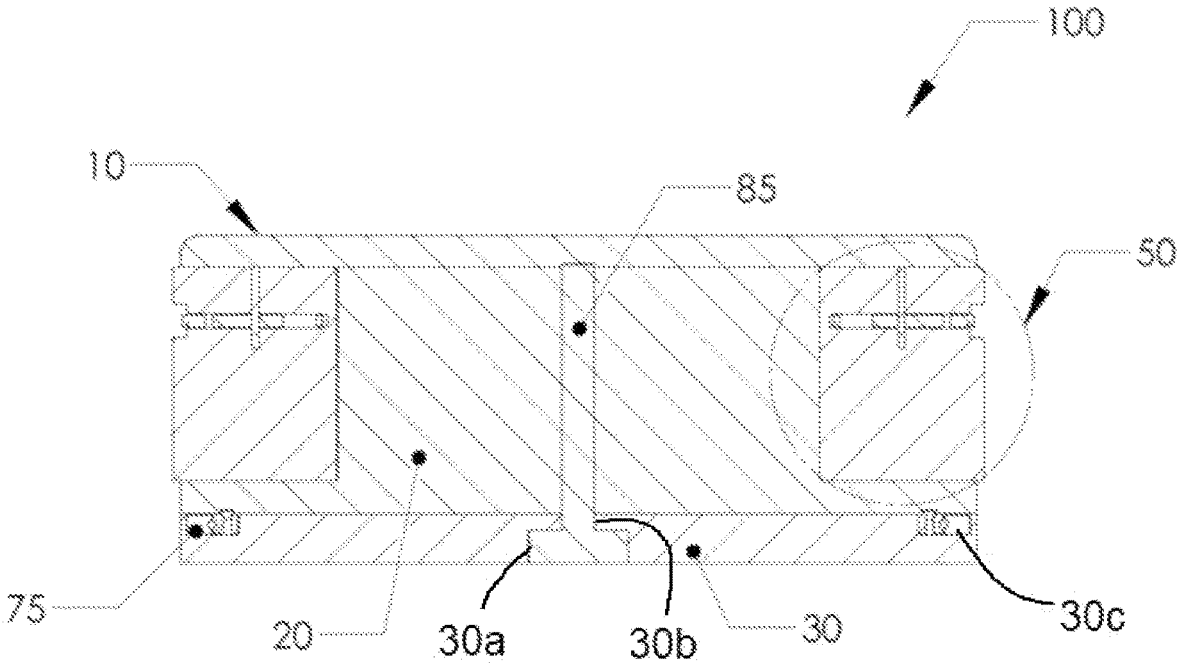

Referring next to FIG. 2, the dispenser 100 is shown in a top view with a sectional view line A-A provided for use in FIG. 2(*a*) to show additional internal components in cross section. The turntable plate 30 contains a center thru hole 30*a* and a blind hole at the bottom surface to provide a means for attachment of a post 85. The top surface of turntable plate 30 has a blind hole to provide a means of attachment of a turntable ring 75. The ring 75 contains ball bearings inside to allow a smooth and quiet rotation of the dispenser when a new medication is selected.

Figure 3:
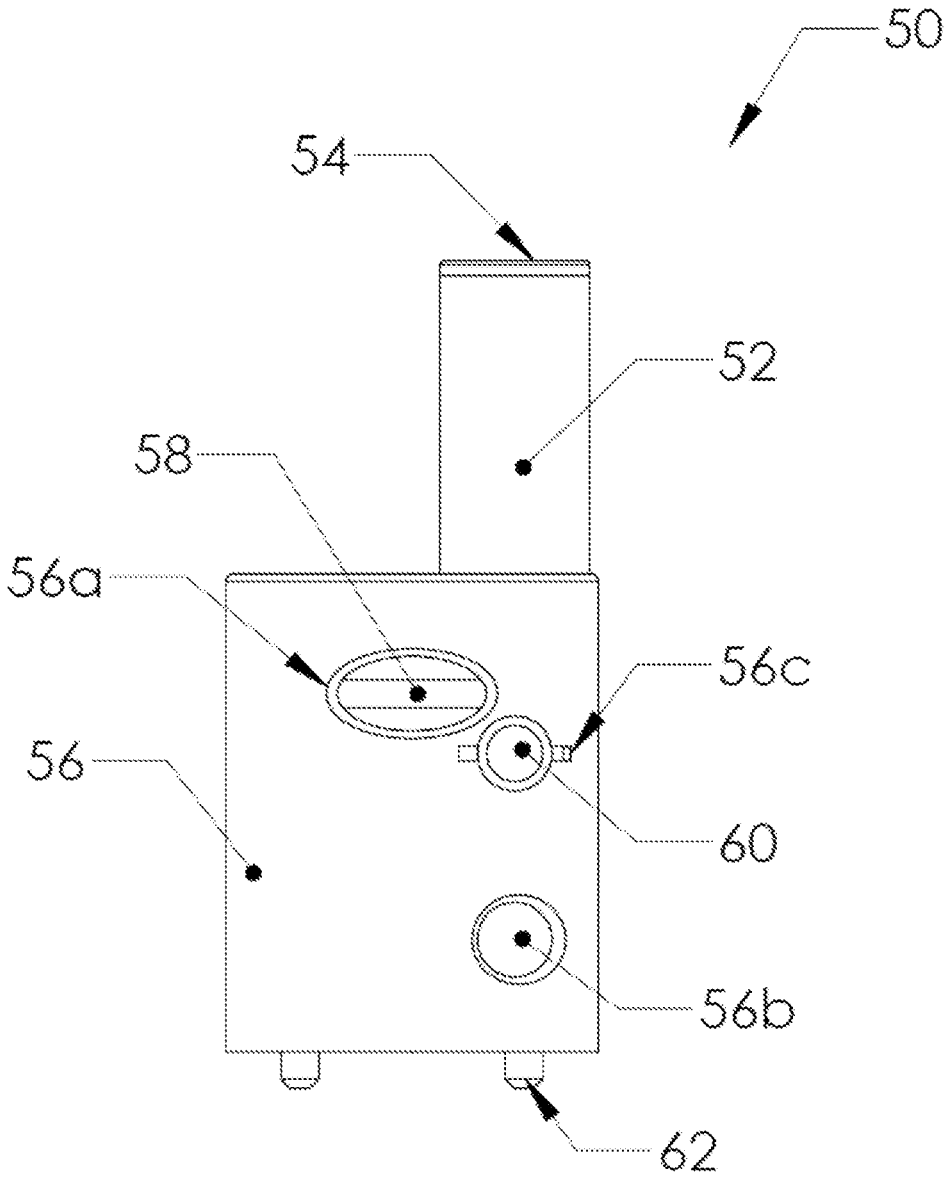
FIG. 3 is a front view of a single pill dispenser module contained within the single pill dispenser.

Referring next to FIG. 3, a front view of the single pill dispenser module 50 is shown. The design of the module 50 allows for various sized pills to be used. Pills are first loaded into pill bottle 52 by opening top cap 54. A housing 56 contains several components that provide a means of pill size selection and single pill dispensing. Aperture 56*a* provides an opening for selecting the specific pill size by rotating size adjustment dial 58. A spring-loaded push button 60 is depressed and immediately released. The internal mechanism of pill release shall be explained later in the specification. Slotted aperture 56*c* provides a means to contain push button 60. Exit aperture 56*b* provides an opening at the bottom of module 50 where single pills are dispensed at. There is a plurality of locating pins 62 at the bottom surface of housing 56 to provide a means of location during assembly into main housing 20.

Figure 4:
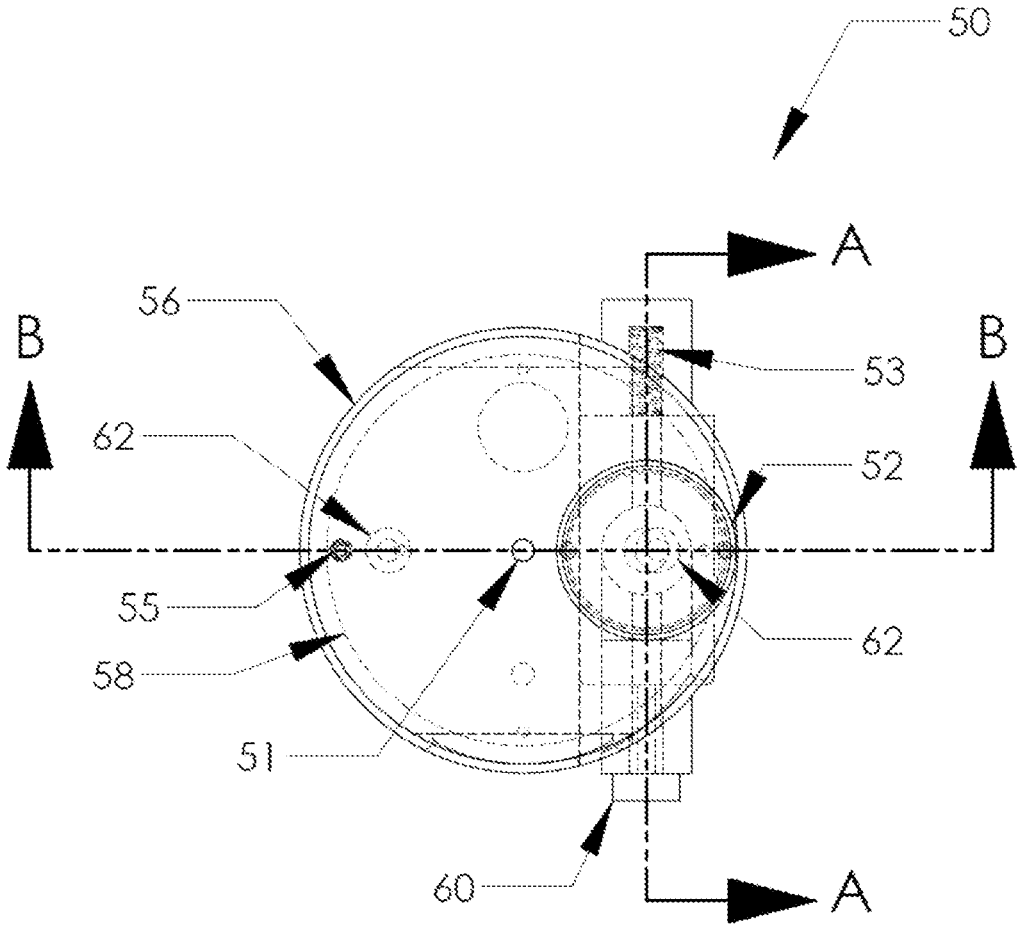
FIG. 4 is a top view of the single pill dispenser module.
Figure 4A:
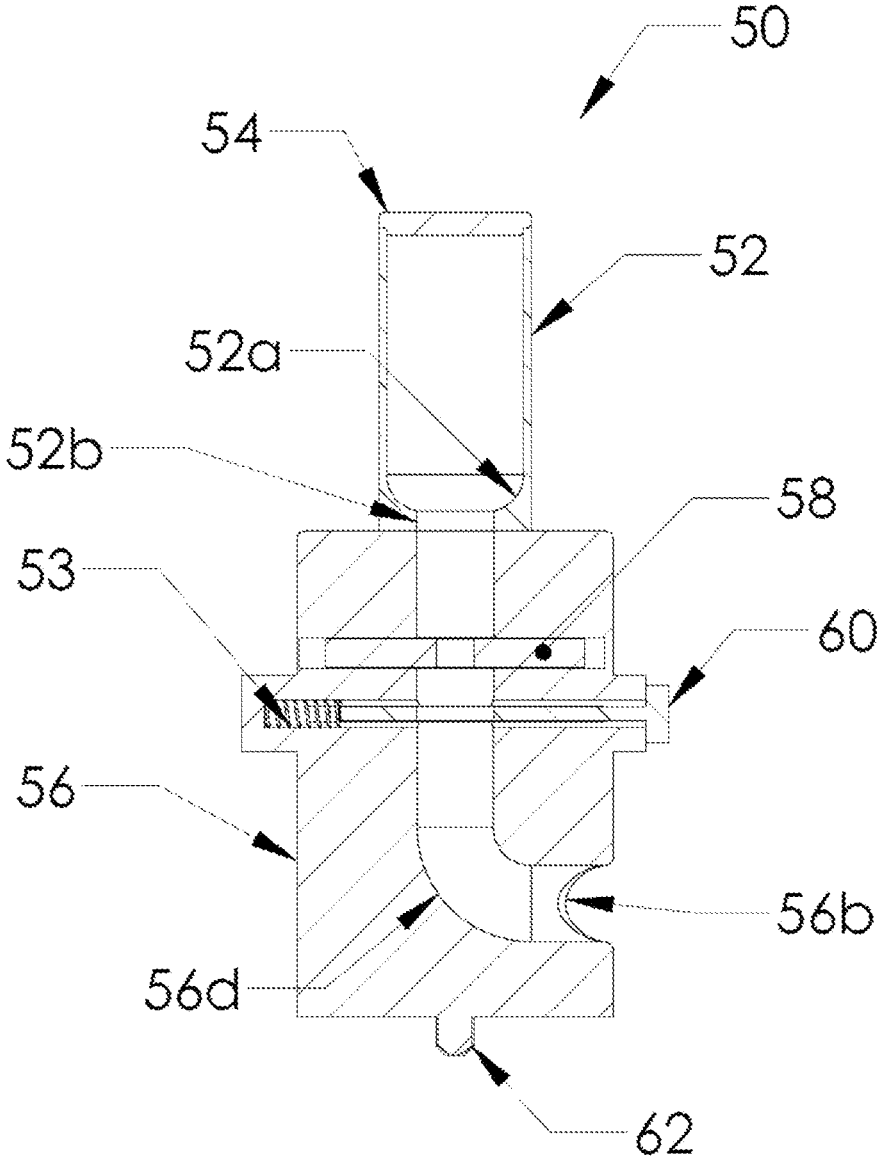
Figure 4B:
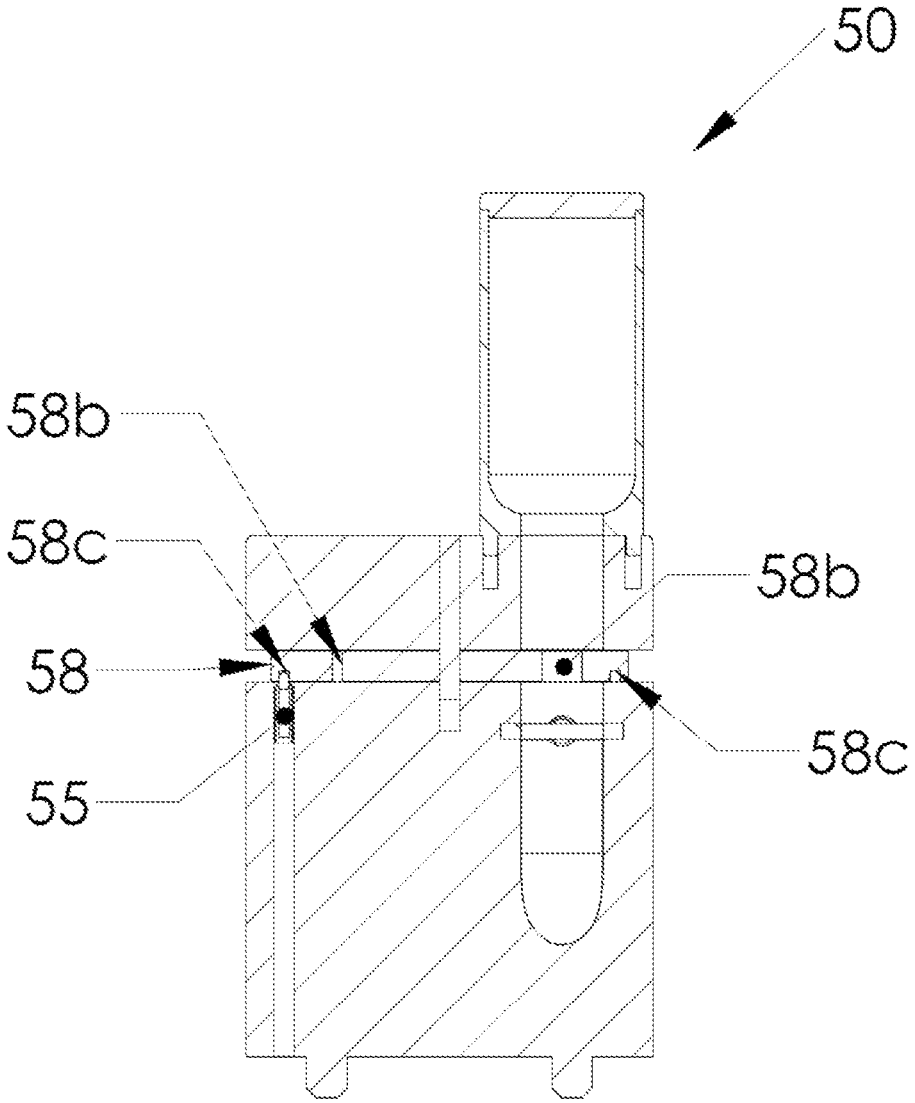
Figure 5:
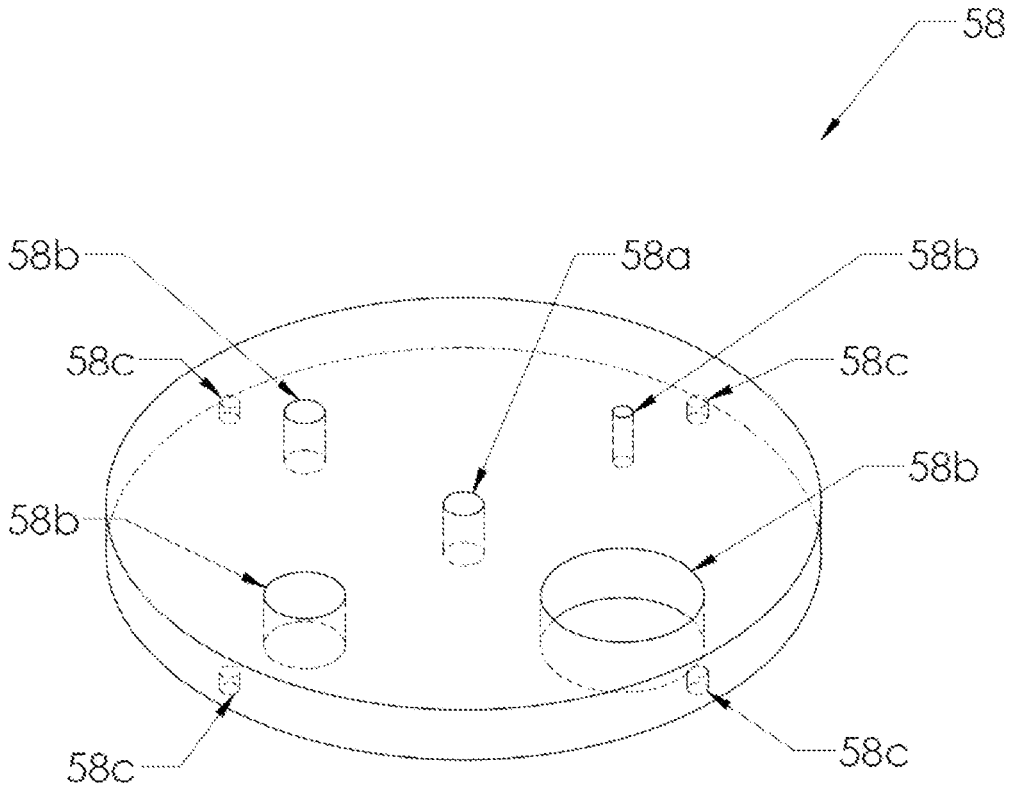
FIG. 5 is a perspective view of the size adjustment dial located within the single pill dispenser module.
Figure 6:
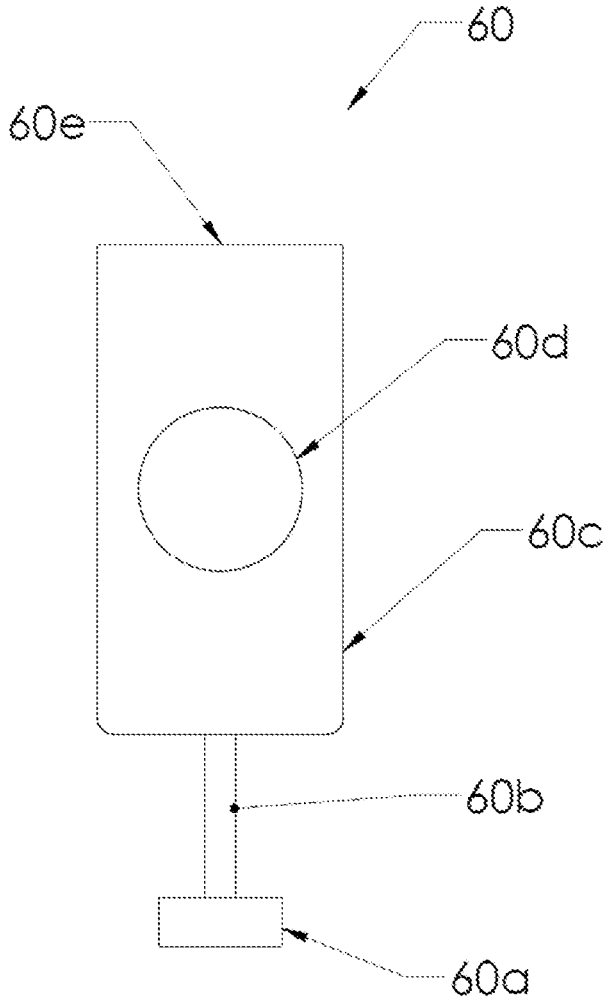
FIG. 6 is a top view of the push button located within the single pill dispenser module.

Referring next to FIGS. 4, 4(*a*) and 5, the dispenser module 50 is shown in top and sectional views to explain the size and single pill dispensing mechanisms. Housing 56 is generally cylindrical but contains two bosses that protrude off to one side. These bosses have internal pockets that house the spring-loaded push button mechanism which consists of a push button 60 located at the front end of module 50 and a compression spring 53 located at the rear end of module 50. The pill size adjustment dial 50 is located directly below the exit aperture 52*a* of bottle 52 and is also shown in detail in FIG. 5. As shown in FIG. 5, the dial 58 comprises a concentric arrangement of apertures 58*b*. Each aperture 58*b* is of a different diameter in order to allow pills of a specific size to pass through. The dial 58 is pinned at the center of housing 56 with a pin 51. A ball nose spring plunger 55 is located beneath the bottom surface of dial 58 and provides a means of fixing the location of dial 58 by frictional contact with blind holes 58*c* located on the bottom surface of dial 58. Holes 58*c* are aligned radially with apertures 58*b*. Pin 51 passes thru dial 58 at the center hole 58*a* to secure the dial yet allow rotation of the dial should the need arise to adjust the size. This might happen for example if a different sized medication is used in the same module later.

Figure 7:
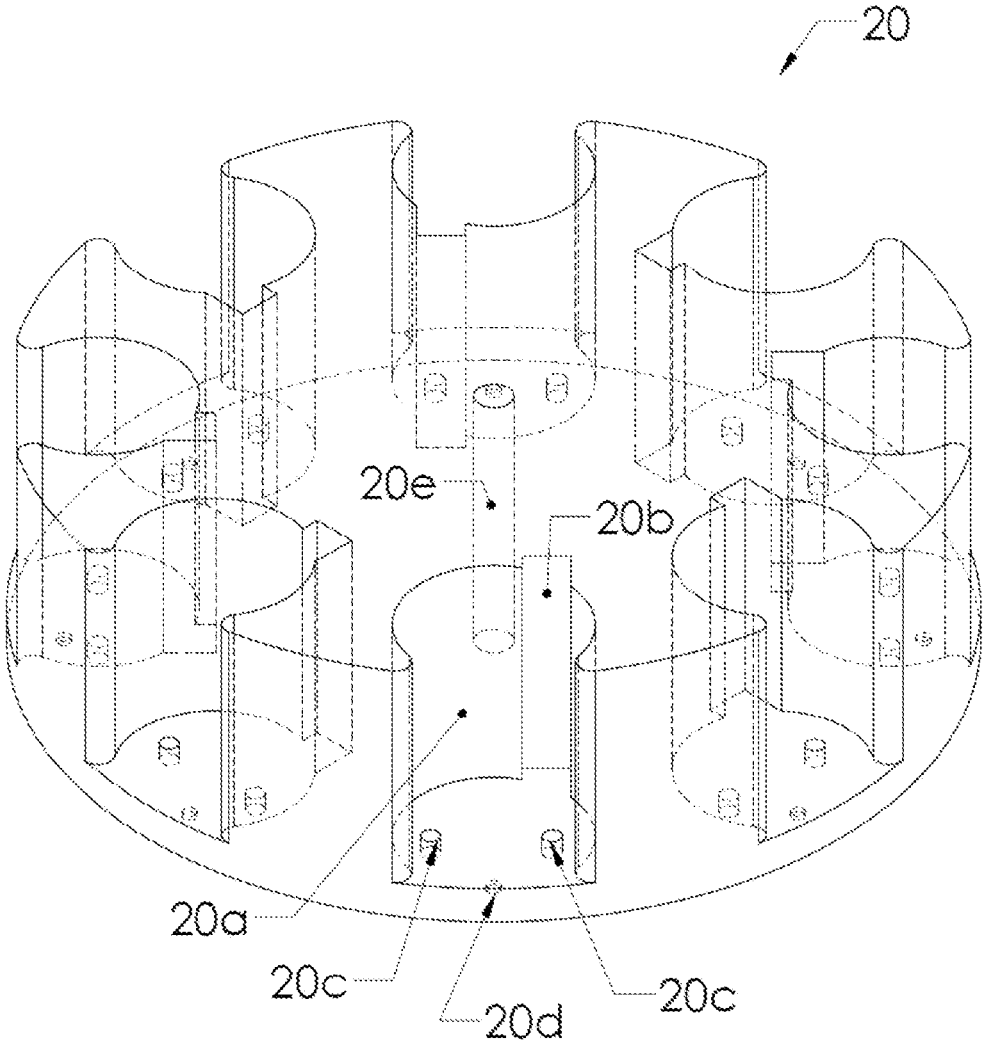
FIG. 7 is a perspective view of the main housing of the single pill dispenser.
Figure 8:
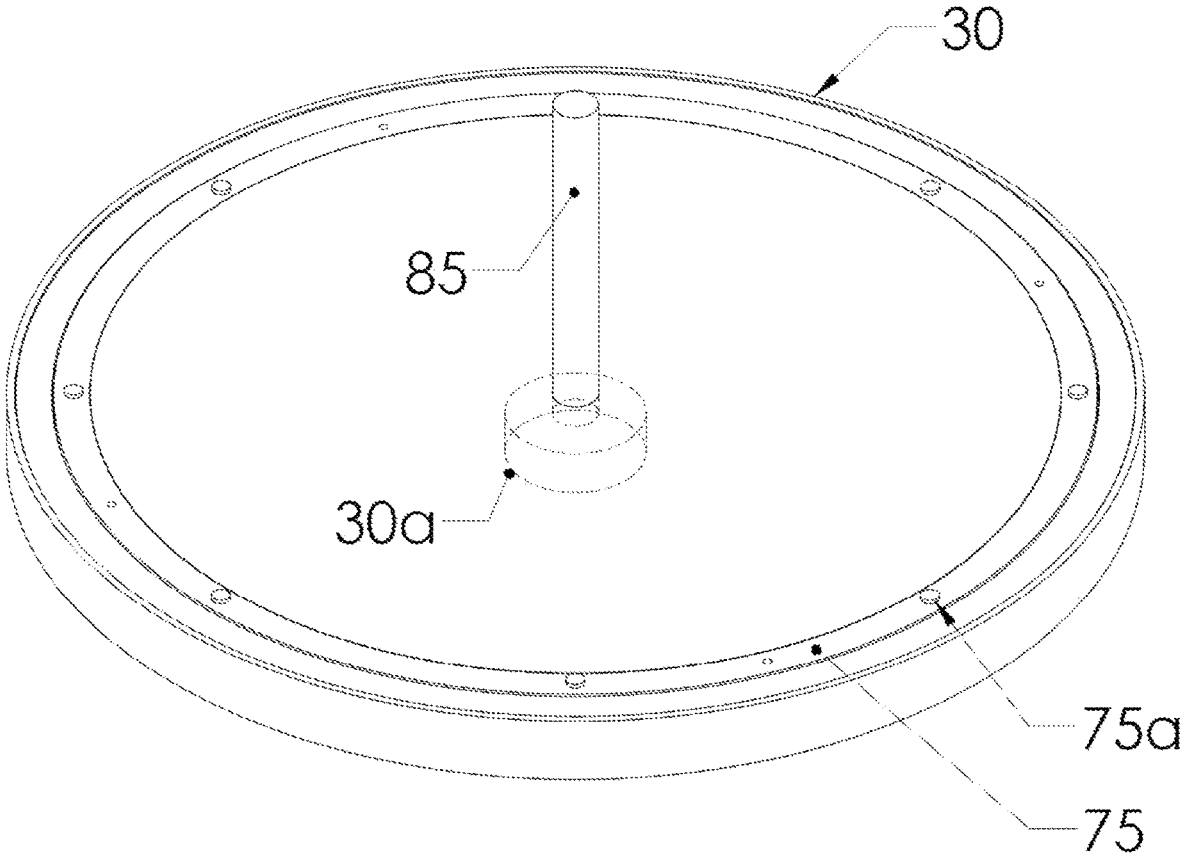
FIG. 8 is a perspective view of the bottom turntable assembly of the single pill dispenser.

Referring now to FIGS. 4(*a*), 6 and 7, the single pill release mechanism shall next be explained. As shown in FIG. 4(*a*), the push button is shown in the depressed position to initiate release of a single pill. Pushing the button 60 will compress spring 53 until the button 60 stops against the housing 56. At this point, a pill will pass thru aperture 60*d* of button 60. The stiffness (or spring constant commonly called k) of spring 53 is an important design factor which will affect the return velocity of button 60. A carefully selected spring constant will provide sufficient force against the button surface 60*e* to shut off aperture 60*d* thus preventing a second pill from being dispensed. The released single pill finally travels down drop chute 56*d* and exits the dispenser at aperture 56*b* located close to the bottom of housing 56. Finally, at least two locating pins 62 are attached to main housing 20 using housing locating blind holes 20*c* as shown in FIG. 7.

Referring finally to FIGS. 2(*a*), 7 and 8, the turning mechanism of dispenser 100 is explained. Turntable plate 30 contains a ball bearing style turntable ring 75 which is located just inside of the perimeter of plate 30 at the top surface. Ring 75 contains a plurality of locating bosses 75*a* to provide a means of engagement to blind holes 20*d* located on main housing 20 (see FIG. 7). Main housing 20 includes a center thru hole 20*e* which allows post 85 (see FIG. 2(*a*)) to be slidably engaged with to allow free rotation of dispenser 100 about the axis of post 85.

What is claimed is:

1. An apparatus for dispensing pills, comprising:

a post having a first base portion and a second rod portion protruding upward from said first base portion;

a plurality of pill dispenser modules;

a turntable ring that is rotatable with respect to said post;

a housing, said housing having a generally cylindrical shape and having a plurality of pockets with each of said plurality of pockets being configured to store a single pill dispenser module of said plurality of pill dispenser modules, said housing having a center hole for slidably attaching said housing to said post, and said housing having a bottom surface having at least one blind hole, with said bottom surface facing said turntable ring, and with said at least one blind hole being mateable with said turntable ring; and a turntable plate, said turntable plate having a center thru hole to provide attachment with said post, and said turntable plate being attachable with said turntable ring.

2. The apparatus as set forth in claim 1, wherein said housing has a second blind hole, wherein said second blind hole is attachable to one of said pill dispenser modules.

3. The apparatus as set forth in claim 1, wherein said turntable ring includes a locating boss configured to engage said at least one blind hole.

4. The apparatus as set forth in claim 3, wherein said turntable ring and said housing are rotatable with one another about said post with respect to said turntable plate.

5. The apparatus as set forth in claim 1, wherein said turntable plate has a circular pocket on a top surface of said turntable plate, and wherein said circular pocket of said turntable plate is configured to receive said turntable ring.

6. The apparatus as set forth in claim 1, wherein said turntable ring contains ball bearings.

7. The apparatus as set forth in claim 1 further comprising a top cover coupled to said housing and having a generally circular shape, wherein said top cover is configured to secure a pill bottle.

8. The apparatus as set forth in claim 1, wherein said first base portion of said post has a first diameter, wherein said second rod portion of said post has a second diameter, and wherein said second diameter of said second rod portion is less than said first diameter of said first base portion.

9. The apparatus as set forth in claim 1, wherein each pocket of said plurality of pockets has a cylindrical shape.

10. The apparatus as set forth in claim 1, wherein each of said pill dispenser modules comprises a pill bottle.

11. The apparatus as set forth in claim 10, wherein a top surface of said housing has a plurality of top surface blind holes, wherein said top surface faces away from said turntable ring, and wherein one of said pill dispenser modules is attachable to one of said top surface blind holes of said plurality of top surface blind holes.

12. The apparatus as set forth in claim 1, wherein each of said pill dispenser modules further comprise a pill dispensing housing defining a drop chute for directing a pill through an exit aperture.

13. The apparatus as set forth in claim 12, wherein each of said pill dispenser modules further comprise a pill size adjustment dial coupled to said pill dispensing housing.

14. The apparatus as set forth in claim 13, wherein said pill size adjustment dial comprises a concentric arrangement of apertures, and wherein each aperture of said concentric arrangement of apertures has a diameter different from another one of said apertures.

15. The apparatus as set forth in claim 14, wherein said pill size adjustment dial is rotatable about a pin that is coupled to said pill dispensing housing.

16. The apparatus as set forth in claim 14 further comprising a plunger coupled to said pill dispensing housing, wherein said pill adjustment dial has a bottom surface defining a plurality of dial blind holes, and wherein said plunger is disposable in each of said dial blind holes to selectively secure said pill adjustment dial with respect to said pill dispensing housing.

17. The apparatus as set forth in claim 12, wherein each of said pill dispensing modules comprises a spring-loaded push button mechanism coupled to said pill dispensing housing.

18. The apparatus as set forth in claim 17, wherein said spring-loaded push button mechanism comprises a push button and a compression spring.

19. The apparatus as set forth in claim 1, wherein said pill dispensing housing comprises at least one locating pin attachable to said housing.

20. The apparatus as set forth in claim 1, wherein said plurality of pill dispenser modules comprises eight pill dispenser modules.

* * * * *